US007021184B2

(12) United States Patent
Sussmeier et al.

(10) Patent No.: US 7,021,184 B2
(45) Date of Patent: Apr. 4, 2006

(54) SYSTEM AND METHOD FOR PROVIDING SHEETS TO AN INSERTER SYSTEM USING A ROTARY CUTTER

(75) Inventors: John W Sussmeier, Cold Springs, CT (US); John R Masotta, Bethel, CT (US); Boris Rozenfeld, New Milford, CT (US); William J Wright, Killingsworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 72 days.

(21) Appl. No.: 10/445,673

(22) Filed: May 27, 2003

(65) Prior Publication Data

US 2004/0237738 A1 Dec. 2, 2004

(51) Int. Cl.

| | |
|---|---|
| ***B65H 30/00*** | (2006.01) |
| ***B65H 29/00*** | (2006.01) |
| ***B65H 9/66*** | (2006.01) |
| ***B26D 7/00*** | (2006.01) |

(52) U.S. Cl. ..... 83/155; 83/408; 270/52.02; 271/185; 271/202; 271/225; 271/270

(58) Field of Classification Search ..... 83/408, 83/155, 155.1; 271/225, 184, 185, 202, 270; 270/52.02

See application file for complete search history.

(56) References Cited

U.S. PATENT DOCUMENTS

| | | | | |
|---|---|---|---|---|
| 4,273,319 | A * | 6/1981 | Stocker | 83/210 |
| 4,753,429 | A * | 6/1988 | Irvine et al. | 271/184 |
| 5,048,810 | A * | 9/1991 | Palmatier et al. | 270/52.08 |
| 5,207,412 | A * | 5/1993 | Coons et al. | 270/52.02 |
| 5,439,208 | A * | 8/1995 | Moser et al. | 271/225 |
| 5,538,240 | A * | 7/1996 | Auerbach et al. | 271/225 |
| 5,617,706 | A * | 4/1997 | Hartman et al. | 83/236 |
| 5,664,772 | A * | 9/1997 | Auerbach et al. | 271/225 |
| 5,924,686 | A * | 7/1999 | Jacobson et al. | 271/3.17 |
| 6,092,802 | A * | 7/2000 | Lackner et al. | 271/225 |
| 6,109,603 | A * | 8/2000 | Stevens et al. | 270/52.09 |
| 6,155,560 | A * | 12/2000 | Cote et al. | 271/225 |
| 6,279,636 | B1 * | 8/2001 | Miller | 156/351 |
| 6,378,861 | B1 * | 4/2002 | Middelberg et al. | 271/225 |
| 6,443,447 | B1 * | 9/2002 | Ifkovits et al. | 271/225 |
| 6,519,503 | B1 * | 2/2003 | Paterson et al. | 270/52.02 |

(Continued)

*Primary Examiner*—Allan N. Shoap
*Assistant Examiner*—Jason Prone
(74) *Attorney, Agent, or Firm*—Michael J. Cummings; Charles R. Malandra, Jr.; Angelo N. Chaolas

(57) ABSTRACT

An inserter input system including a web feeder providing a web of printed material to be split by a web slitting knife along the web's direction of travel. The split web is then cut transverse to the direction of travel by a rotary cutter operating at a first velocity, resulting in side-by-side individual sheets. Downstream of the rotary cutter, a right angle turn mechanism receives each of the side-by-side sheets and reorients them by ninety degrees. Further the right angle turn reorients the sheets into a serial shingled arrangement. A high speed separation nip pulls individual shingled sheets out from the shingled arrangement. The speed of the separation nip is such that a predetermined gap between the previously shingled sheets is formed. In a further preferred embodiment of the present invention, the speed of the rotary cutter and right angle turn mechanism are controlled to adjust a quantity of sheets that would be generated from displacement traveled due to inertia during a deceleration of the system to a stop.

9 Claims, 3 Drawing Sheets

U.S. PATENT DOCUMENTS 6,659,445 B1 * 12/2003 Boss ..... 271/202
6,719,522 B1 * 4/2004 Gunther ..... 271/225
6,915,184 B1 * 7/2005 Yates et al. ..... 270/52.02
2002/0084570 A1 * 7/2002 Kayani ..... 271/10.01
2004/0173958 A1 * 9/2004 Graushar ..... 270/52.02
2005/0056989 A1 * 3/2005 Schwab ..... 270/52.02

* cited by examiner

SYSTEM AND METHOD FOR PROVIDING SHEETS TO AN INSERTER SYSTEM USING A ROTARY CUTTER

TECHNICAL FIELD

The present invention relates to an inserter input system for generating sheets of printed material to be collated and inserted into envelopes. Such an inserter input system cuts and processes a continuous web of material into individual sheets. The individual sheets may then be processed into individual mail pieces.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford, Conn.

In many respects, the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 10. The continuous web must be separated into individual document pages. This separation is typically carried out by a web cutter 20 that cuts the continuous web into individual document pages. Downstream of the web cutter 20, a right angle turn 30 may be used to reorient the documents, and/or to meet the inserter user's floor space requirements.

The separated documents must subsequently be grouped into collations corresponding to the multi-page documents to be included in individual mail pieces. This gathering of related document pages occurs in the accumulator module 40 where individual pages are stacked on top of one another.

The control system for the inserter senses markings on the individual pages to determine what pages are to be collated together in the accumulator module 40. In a typical inserter application, mail pieces may include varying numbers of pages to be accumulated. For example, the phone bill for a person who lives by himself may be much shorter than another phone bill representing calls made by a large family.

It is this variation in the number of pages to be accumulated that makes the output of the accumulator 40 asynchronous, that is, not necessarily occurring at regular time intervals.

Downstream of the accumulator 40, a folder 50 typically folds the accumulation of documents, so that they will fit in the desired envelopes. To allow the same inserter system to be used with different sized mailings, the folder 50 can typically be adjusted to make different sized folds on different sized paper. As a result, an inserter system must be capable of handling different lengths of accumulated and folded documents.

Downstream of the folder 50, a buffer transport 60 transports and stores accumulated and folded documents in series in preparation for transferring the documents to the synchronous inserter chassis 70.

In a typical embodiment of a prior art web cutter 20, the cutter is comprised of a guillotine blade that chops transverse sections of web into individual sheets. This guillotine arrangement requires that the web be stopped during the cutting process. As a result, the web cutter 20 transports the web in a sharp starting and stopping fashion and subjects the web to high accelerations and decelerations.

With the guillotine cutter arrangement, the web feeder 10 may typically include a loop control module to provide a loop of slack web to be fed into the web cutter 20. During high speed operation, the accelerations experienced by the web in the slack loop can be quite severe. The inertia experienced by the web from the sudden starting and stopping may cause it to tear or become damaged.

An alternative to the guillotine cutter arrangement is an arrangement using a rotary cutter. A rotary cutter utilizes a blade positioned transversely along a roller in a roller arrangement through which the web is transported. The rotary cutter module can simultaneously serve to continuously transport the web while cutting it into to predetermined length pieces as the blade on the roller comes into contact with the paper while the roller turns.

The rotary cutter arrangement does not include the disadvantage of sudden starting and stopping. However, a different disadvantage exists in that a rotary cutter requires a significant amount of time to decelerate when a downstream condition occurs that requires the system to stop. While the rotary cutter is decelerating to a stop, a number of additional sheets will be cut for which there may be no downstream space to accommodate.

A frequent limitation on speed of an inserter system is the ability of the system to handle all of the generated documents if the system is required to stop. An input system may be capable of going very fast under non-stop operating conditions, but a problem arises during stopping if there isn't a means to handle all the sheets produced by the input system. Thus in designing input stages to an inserter system, a consideration is to provide a place for all "work-in-progress" sheets and collations, assuming that the system may be required to stop at any time. A buffer module such as the ones described in co-pending patent applications Ser. No. 10/329,031 (issued as U.S. Pat. No. 6,687,570 on Feb. 3, 2004) and Ser. No. 10/328,971, (issued as U. S. Pat. No. 6,687,569 on Feb. 3, 2004), both filed on Dec. 24, 2002 and assigned to the assignee of the present application, may be used to provide stopping stations, or "parking spots," for work-in-progress documents.

For proper operation, an inserter input system should not be run faster than spaces for holding work in progress can be made available. For mail runs including mail pieces having larger numbers of sheets, the problem is less severe since sheets from the same mail piece are stored together in the buffer stations. For mail runs with mail pieces only having a few sheets, the ratio of required stopping stations to the number of sheets generated will be greater, and the inserter input may be required to slow down.

The work-in-progress problem is amplified when a rotary cutter is used. Because of its greater inertia, a rotary cutter cannot be stopped as quickly as the guillotine style cutter. Thus, even more buffer capacity for handling and storing work in progress sheets must be included. Such additional capacity typically adds to the size and expense of the system.

One prior art solution to this disadvantage of rotary cutters has been to incorporate a vertical sheet stacking device downstream of the rotary cutter. Thus, any number of sheets cut from the rotary cutter could be piled into a vertical stack of individual sheets. Sheets may then be drawn from the bottom of the vertical stack as needed, and the problem of insufficient downstream space during a stopping condition is avoided. Such a vertical staking device is sometimes referred to as a "refeed device."

Unfortunately, while solving one problem with rotary cutters, refeed devices cause another problem of their own. Refeed devices have been found to be insufficiently reliable for consistent feeding of cut sheets in the input subsystem of a high-speed inserter. For varying sheets sizes, paper weights, and curl conditions, a vertical stack feeding device has been found to incorrectly feed sheets from the bottom of the stack.

SUMMARY OF THE INVENTION

The present invention overcomes disadvantage of the prior art by obtaining performance characteristics of a rotary cutter without having to use unreliable refeed devices to accommodate sheets generated during a stopping condition. The invention also provides efficiency in that the preferred embodiment can handle the necessary number of sheets using relatively little floor space, and without significant lengthening of a buffer module.

An inserter input system in accordance with the present invention begins with a web feeder providing a web of printed material. A web slitting knife splits the web along its direction of travel into at least two portions. While the preferred embodiment of the present invention operates on web in two side-by-side portions, the invention may be utilized by a web split into any number of portions along its length.

After the web is split along its length, a rotary web cutter cuts the web in a direction transverse to the travel direction. Thus, the web is cut into at least two side-by-side sheets. The rotary cutter is typically comprised of a rotating roller with a blade along its length. Downstream of the rotary cutter, a right angle turn mechanism receives each of the side-by-side sheets and reorients them by ninety degrees. Also, the sheets are changed from the side-by-side orientation to a serial and shingled arrangement. This serial shingled arrangement provides storage capacity for sheets over a shorter length.

For further downstream processing, a high speed separation nip pulls individual shingled sheets out from the shingled arrangement. The speed of the separation nip is such that a predetermined gap between the previously shingled sheets is formed. This gap is sufficient that downstream processing, such as selectively diverting sheets into accumulator bins, may be performed.

In a further preferred embodiment of the present invention, the speed of the rotary cutter and right angle turn mechanism are controlled to adjust a quantity of sheets that would be generated from inertia during a deceleration of the system to a stop. Speeds are maintained such that, assuming the system may be required to stop at any time, no more sheets will be presented to the high speed separation nip than may be accommodated at available downstream parking spots.

Further details of the present invention are provided in the accompanying drawings, detailed description, and claims.

DETAILED DESCRIPTION

Figure 1:
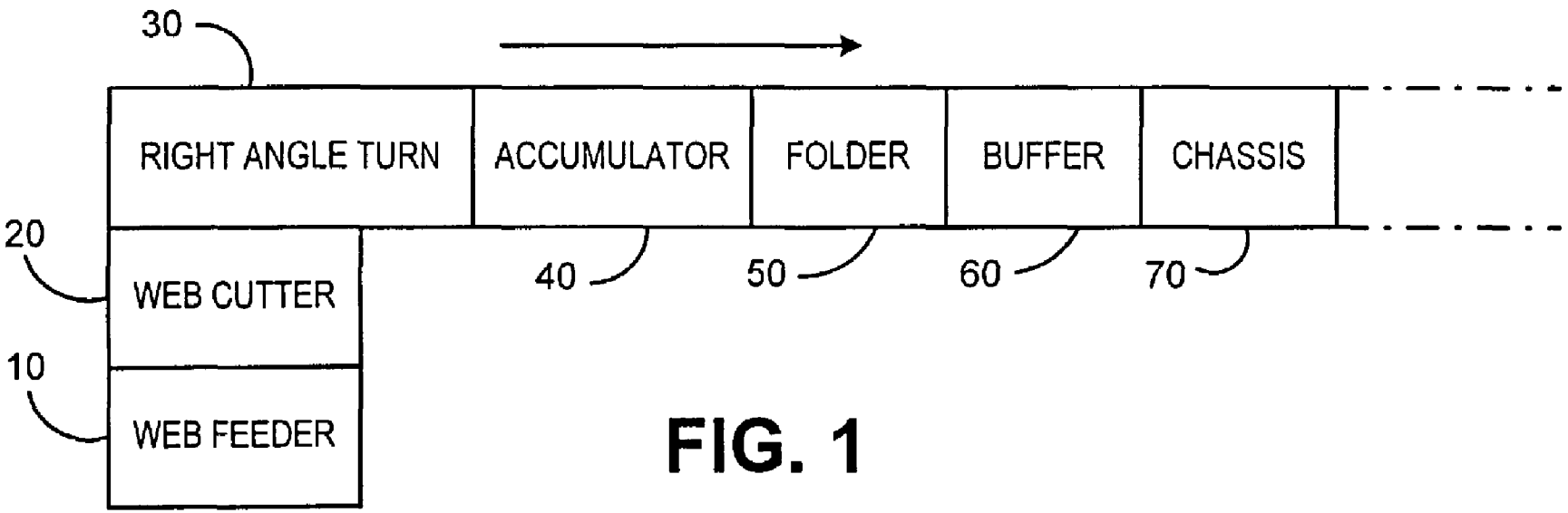
FIG. 1 is a diagram of the input stages of an inserter system for use with the present invention.
Figures 2, 2A:
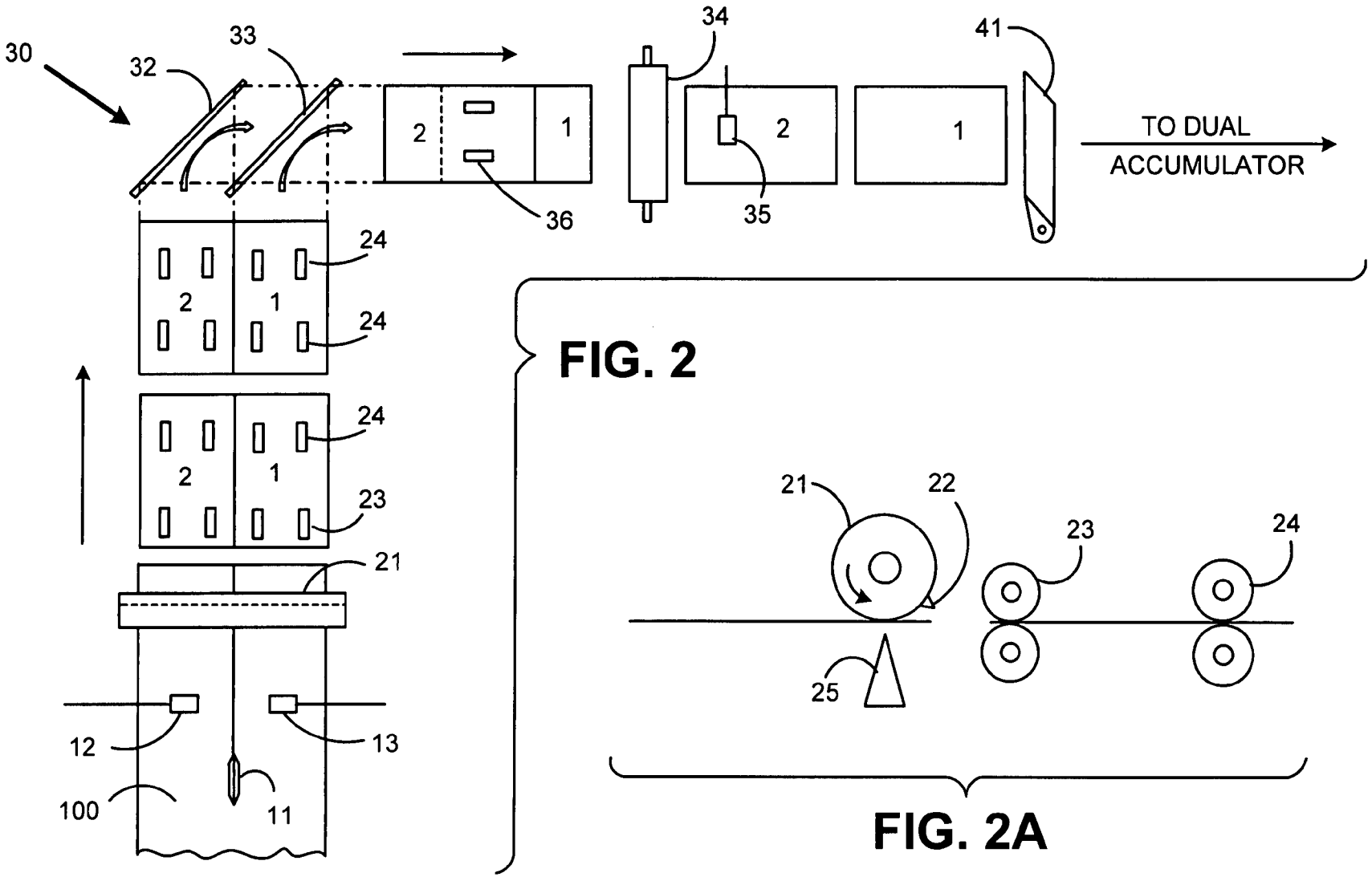
FIG. 2 depicts a preferred arrangement of inserter input devices in accordance with the present invention cutting and transporting documents.
FIG. 2A depicts a preferred rotary cutter and transport arrangement for use with the present invention.

A preferred embodiment for implementing the present invention is depicted in FIG. 2. The components depicted in FIG. 2 may be associated with the general input stages depicted in FIG. 1, however it is not necessary that the particular components be part of any particular module, so long as they perform as described herein.

A web 100 is drawn into the inserter input subsystem. Methods for transporting the web are known and may include rollers, or tractors pulling on holes along a perforated strip at the edges of the web. The web 100 is split into two side-by-side portions by a cutting device 11. Cutting device 11 may be a stationary knife or a rotating cutting disc, or any other cutting device known in the art. While the embodiment in FIG. 2 shows the web being split into two portions, one skilled in the art will understand that a plurality of cutting devices 11 may be used to create more than two strands of web from the original one. Further, the processing steps described below will also be as applicable to webs that are split into more than two portions.

Sensors 12 and 13 scan a mark or code printed on the web. The mark or code identify which mail piece that particular portion of web belongs to, and provides instructions for processing and assembling the mail pieces. In addition to using the scanned information for providing assembling instructions, the scanning process is useful for tracking the documents' progress through the mail piece assembly process. Once the location of a document is known based on a sensor reading, the document's position may be tracked throughout the system by monitoring the displacement of the transport system. In particular, encoders may be incorporated in the transport systems to give a reliable measurement of displacements that have occurred since a document was at a certain location.

After the web 100 has been split into at least two portions, the web is then cut into individual sheets by rotary cutter 21. In addition to being a roller capable of transporting the web portions, rotary cutter 21 is comprised of a cutting blade 22 that separates the web into the sheets as it rotates, and a stationary blade 25. The cut is made across the web, transverse to the direction of transport. FIG. 2A provides a further side view of the rotary cutting operation.

Downstream of the rotary cutter 21 the individual cut sheets are engaged by nips 23. Nips 23 serve to further transport sheets downstream for further processing. In addition, nips 23 preferably help to create a predetermined gap between subsequent sets of cut sheets. This is accomplished by setting the transport speed of nips 23 to be slightly faster than the transport speed of the upstream web. Thus, when nips 23 grab the individual sheets designated as 1 and 2, those sheets are pulled away from the slower moving portion of the uncut web that is still within the rotary cutter 21. Nips 24 further serve to transport the sheets to the right angle turn 30 portion of the system.

Right angle turn devices 30 are known in the art and will not be described in detail here. However, and exemplary right angle turn will comprise turn bars 32 and 33. Of the two paper paths formed by the right angle turn 30, turn bar 33 forms an inner paper path for transporting sheet 1. Turn bar 32 forms a longer outer paper path on which sheet 2 travels.

Because sheets 1 have a shorter path through the right angle turn 30, a lead edge of sheet 1 will be in front of a lead edge of sheet 2 downstream of the right angle turn 30. Also, the turn bars 32 and 33 are arranged such that sheet 2 will lay on top of sheet 1 downstream of the right angle turn, thus forming a shingled arrangement. Downstream of the right angle turn 30, further sets of roller nips 36 transport the shingled arrangement of sheets.

In a preferred embodiment, the turn bars 32 and 33 are further arranged so that a lead edge of a subsequent sheet on the shorter path will catch up to, and pass, the trailing edge of the prior document on the longer path. The result of this arrangement can be seen in FIG. 3, where sheet 1 is the sheet that traveled on the shorter path through the right angle turn. Sheet 2 was previously side-by-side with sheet 1, but is now shingled on top of sheet 1. Sheet 3 is a sheet that followed sheet 1 on the shorter paper path through the right angle turn 30, and a lead portion of sheet 3 is now shingled under sheet 2. Finally, sheet 4, previously the side-by-side portion paired with sheet 3, is shingled on top of the rear portion of sheet 3.

In accordance with a preferred embodiment of the present invention, all of the transport mechanisms between the rotary cutter 21 and high speed separation nip 34 operate at the same speeds. Collectively, the transport mechanisms may be referred to herein as the "right angle turn transport," and include rollers 23, 24, 36, and turn bars 32 and 33. Preferably the components of the right angle turn transport are electronically or mechanically geared to one another so that speeds are always consistent throughout.

The shingling of sheets provides a means for storing a greater number of sheets in a smaller amount of space. Thus, the prior art problem of rotary cutters creating additional sheets during a stopping condition is partially mitigated. When a downstream stopping condition occurs, the rotary cutter 21 begins its deceleration. Upon the occurrence of such a stopping condition the right angle turn transports are subjected to a controlled deceleration to receive and store the extra sheets before coming to a complete stop.

Preferably, the speeds of the rotary cutter 21 and right angle turn transport are controlled so that no more sheets than may be accommodated are produced. Unlike some prior art systems, the right angle turn transports pursuant to the present invention are capable of storing sheets during a stopping condition. Thus, a rotary feeder 21 is effectively used for input to a high speed inserter system without requiring a prior art re-feed device.

Figure 3:
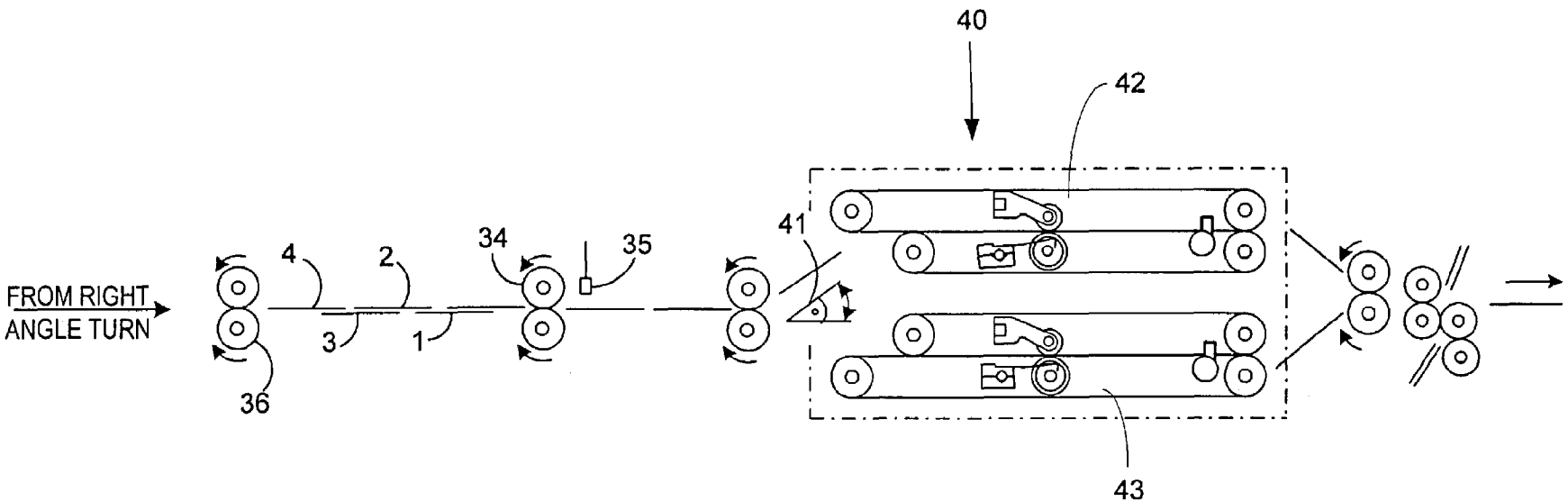
FIG. 3 depicts a side view of the document flow downstream of the right angle turn in accordance with a preferred embodiment of the present invention.

Referring to FIG. 3, the shingled sheets 1, 2, 3, 4, must be unshingled. This is accomplished by the high speed separation nip 34. As the name suggests, nip 34 operates at a higher speed than the upstream right angle transports and pulls the lead edges of sheets out of the shingled arrangement. The speed of the high speed separation nip 34 is selected so that downstream of the nip 34 the sheets are traveling serially, and are separated by a predetermined gap. Preferably, high speed separation nip 34 operates at a constant high velocity, and is not controlled as part of a stoppage condition.

Downstream of nip 34, a sensor 35 scans a code on the sheets. Once again this scanned code links the particular sheet to a set of instructions for assembling the mail pieces. Sensor 35 further is used to confirm that the sheets detected by sensors 12 and 13 have arrived as expected. Of particular interest at this stage of the production process is the number of sheets belonging to a particular mail piece, and which sheets go together to form the same mail piece. Based on mail piece information determined from the sensors, flipper gate 41 directs sheets belonging to the same mail piece to one of two accumulator bins 42 and 43 of accumulator 40.

Any type of accumulator may be used, however, the accumulator 40 depicted in FIG. 3 is based on the one from U.S. patent application Ser. No. 10/029,337 filed Oct. 25, 2001 (issued as U.S. Pat. No. 6,644,657 on Nov. 11 2003). Another dual accumulator is described in U.S. Pat. No. 5,083,769 issued Jan. 28, 1992.

While one accumulator bin (42 or 43) is receiving documents to be stacked into an accumulation, the other bin transfers its completed stack to the next stage for processing. Downstream of the accumulator 40, collations of sheets are returned to a single paper path. In a typical embodiment, the next processing station downstream of the accumulator 40 will be a folder 50 configured to fold the collation to a required by the control system.

In a preferred embodiment of the present invention, only one bin of the accumulator 40 is dedicated to providing a parking spot for additional sheets generated as a consequence of the deceleration period required for the rotary cutter 21. The number of sheets cut by the rotary cutter 21 during deceleration will be a function of how fast the rotary cutter was going when the deceleration instruction is received.

However, the number of sheets created during deceleration is not enough to know how may parking spots are required. Since all of the sheets for one collation are stored together, only one parking spot is needed for all the sheets of a given accumulation. Thus, if the collation to be stored includes four sheets, one parking space is sufficient and four sheets may be allowed to reach the high speed separation nip 34. However, if the next four sheets each comprise single sheet collations, then a single parking space is insufficient, and three sheets may become improperly accumulated with sheets from different mail pieces.

Accordingly, it is an objective of a preferred embodiment of the present invention to take into account the number of sheets in the mail piece being delivered to the accumulator 40. As discussed above, the number of sheets in a mail piece entering the accumulator 40 may be determined based on the code on the sheets scanned by sensors 12, 13 and 35. In response to the number sheets in the collation arriving at the high speed separation nip 34, the speeds of the rotary cutter 21 feed and the right angel turn transport mechanisms are adjusted to ensure that only one parking space will be needed to account for the additional sheets generated during rotary cutter 21 deceleration.

Accordingly, referring to FIG. 3, if sheet 1 were known to be a single sheet collation, then the speed of the rotary cutter 21 and the right angle turn transports would be adjusted to a low velocity. The low velocity should be such that, if required to stop, the rotary cutter 21 would not produce no more sheets than would result in more than one sheet reaching the high speed separation roller 34. If the mail piece prior to sheet 1 had included more than one sheet, then this would require a decrease in speed of the rotary cutter 21 and the right angle turn transports. The shingling arrangement downstream of the rotary cutter 21 allows that more than one sheet may be cut without necessarily causing more than one sheet to arrive at the nip 34.

Continuing with the example started above, if sheet 2 of FIG. 3 were determined by sensor 12, 13, and 35 to be the first sheet of a three page mail piece then the rate of the rotary cutter 21 and right angle turn transports could be increased accordingly.

The particular requirements for velocity changes will be functions of the characteristics of the hardware, and of the size of the paper that is being processed. The exemplary system characteristics are provided below to show how an embodiment would operate for particular conditions.

For this example, it is assumed that the web 100 is being cut into 8½×11 inch sheets, and that the rotary cutter 21 is capable of decelerating at 0.98 G's, with a maximum cutting rate of 36,000 cuts per hour. The velocity of the paper in the rotary cutter is a maximum of 110 in/s. The right angle turn transport is proportionally geared (electronically or mechanically) to the rotary cutter and operates at a maximum of 150 in/s. The distance from the rotary cutter blade 22 to a mid-point of both turning devices 32 and 33 is 16 inches. The paper path length around the outer turning device 32 is 8.5 inches (the width of a sheet) longer than the paper path length around the inner turning device 33. From, the mid-point of the inner turning device 33 to the high speed separation nip is 17 inches. Finally, the high speed separator nip 34 operates at a constant transport velocity 280 inches per second.

Preferably, the rates of the rotary cutter 21 and right angle turn transports are adjusted at least every 500 microseconds second as a function of a sheet, count per collation of "n" sheets positioned just prior to reaching the high speed separator nip 34. As discussed above, sensors 12, 13, and 35 may be used to determine the position of the sheets. The position of sheets downstream of sensors 12 and 13 may be determined based on tracking an encoder count for the transports between the sensors and nip 34. Alternatively, additional sensors may be used to determine the position of sheets just upstream of nip 34.

Based on these exemplary parameters, the following table displays the resulting system throughput, rotary cutter speed, cutter velocity (Vcut), and right angle turn transport speed (Vrat).

| n (sensed sheets/collation) | Throughput (collations/hr) | Cutter speed (cuts/hr) | Vcut (ins/s) | Vrat (in/s) |
|---|---|---|---|---|
| 1 | 26.0 K | 13.0 K | 39.9 | 54.4 |
| 2 | 24.8 K | 24.8 K | 75.8 | 103.3 |
| 3 | 23.6 K | 35.4 K | 108.2 | 147.5 |
| 4 | 18 K | 36 K | 110.0 | 150.0 |
| 5 | 14.4 K | 36 K | 110.0 | 150.0 |
| 6 | 12 K | 36 K | 110.0 | 150.0 |

For this exemplary set of parameters, it is seen that when a collation having three or less sheets is detected approaching the high speed separation nip 34, then the rotary cutter 21 and the right angle turn transport will be required to operate at less than its full speed. When the collations are comprised of four or more sheets, the shingled sheet arrangement and available parking spaces are readily able to absorb all of the additional sheets that would be generated while decelerating the rotary cutter 21 to a stop. Using this exemplary system, for those situations where mail pieces are generally made up of larger numbers of sheets the limitation on the speed of the inserter input system will be the speed at which the rotary cutter can operate. Thus, for each sample period, the right angle turn transport velocity and the rotary cutter 21 velocity are preferably adjusted in accordance with predetermined velocities, as a function of the sheet counts per collation, as depicted in the table above.

The values above are calculated assuming that only one parking spot is available to accommodate sheets generated during deceleration. Making more than one parking spot available would facilitate faster operation, but would add to the length and expense of the system. Additional parking spots would allow greater velocities for the rotary cutter 21 and right angle turn transport for collations having fewer numbers of sheets. However, because of the additional cost and size, the preferred embodiment only utilizes one parking spot to accommodate sheets resulting from stopping rotary cutter 21.

Based on the arrangement described above, the lead edges of the shingled sheets 1 and 2 from the same side-by-side pair will be 8.5 inches apart. However, the distance from a lead edge from FIG. 3 sheet 2 to sheet 3 will be 6.5 inches (this takes into account a four inch gap generated between pairs of side-by-side sheets resulting from the initial separation transport 23).

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. An inserter input system comprising:

a web feeder providing a web of printed material, the web feeder feeding the web at a first velocity in a first direction;

a web slitting knife splitting the web along the first direction into at least two portions;

a web cutter cutting the portions of slit web transverse to the first direction while the web is transported through the web cutter at the first velocity to form side-by-side individual sheets;

a right angle turn mechanism downstream of the web cutter whereby the individual sheets are rearranged to be one on top of the other in a shingled arrangement;

a high speed separation transport downstream of the right angle turn and pulling individual shingled sheets out from the shingled arrangement and whereby sheets are thereafter transported serially and separated by predetermined gaps; and one or more sensors for scanning a code on a document processed by the inserter input system, the code indicating a number of sheets for a collation to which the document belongs, the one or more sensors further providing a position indication of the document in the inserter input system, wherein responsive to the one or more sensors, the web feeder is arranged to adjust the first velocity as a function of the number of sheets in the collation arriving at the high speed separation transport, whereby a lower number of sheets in the collation corresponds to decreasing the first velocity, and a greater number of sheets in the collation corresponds to increasing the first velocity.

2. The inserter input system of claim 1 wherein the web cutter operates at a rate proportionally geared to the first velocity.

3. The inserter input system of claim 1 wherein the web cutter is a rotary web cutter.

4. The inserter input system of claim 1 further comprising a first separation transport downstream of the web cutter and before the right angle turn mechanism the first separation transport operating at a second velocity faster than the first velocity and causing a first predetermined gap to form between consecutive sets of side-by-side individual sheets that were cut by the web cutter, the second velocity further being proportionally geared to the first velocity.

5. The inserter input system of claim 4 wherein the right angle turn mechanism operates at the second velocity and the high speed separation transport operates at a constant third velocity greater than the second velocity.

6. The inserter input system of claim 5 wherein responsive to the one or more sensors, the first separation transport and the right angle turn mechanism are arranged to adjust the second velocity as a function of a number of sheets in the collation arriving at the high speed separation transport, whereby a lower number of sheets in the collation corresponds to decreasing the second velocity, and a greater number of sheets in the collation corresponds to increasing the second velocity.

7. The inserter input system of claim 1 wherein the right angle turn mechanism comprises parallel forty five degree turning bars further comprising a first turning bar forming an inner paper path having a first turning path length, and a second turning bar forming an outer paper path having second turning path length, the second turning path length being longer than the first turning path length.

8. The inserter input system of claim 7 wherein the first and second turning bars are spaced apart as a function of a sheet length of the sheets such that the shingling arrangement comprises the sheets transported on the inner paper path being positioned at the bottom of the shingling arrangement and sheets transported on the outer paper path being positioned on the top of the shingling arrangement.

9. The inserter input system of claim 1 further comprising a transport mechanism for transporting sheets from the web cutter to the right angle turn mechanism and from the right angle turn mechanism to the high speed separation transport; and wherein the transport mechanism, and the right angle turn mechanism are controlled to decelerate to a stop and hold sheets upon an occurrence of a downstream stopping condition.

* * * * *